US006874288B1

(12) United States Patent
Washa et al.

(10) Patent No.: US 6,874,288 B1
(45) Date of Patent: Apr. 5, 2005

(54) CONCRETE DECK DEPRESSION FORM SYSTEM

(75) Inventors: John G. Washa, McFarland, WI (US); Michael R. Lampley, Livermore, CA (US)

(73) Assignee: Crete-Form, Inc, Stoughton, WI (US)

( * ) Notice: Subject to any disclaimer, the term of this patent is extended or adjusted under 35 U.S.C. 154(b) by 113 days.

(21) Appl. No.: 10/356,962

(22) Filed: Feb. 3, 2003

(51) Int. Cl.[7] ..... E04B 2/00

(52) U.S. Cl. ..... 52/371; 52/155; 249/18; 249/139

(58) Field of Search ..... 52/371, 169.12, 52/155, 396.02, 396.04, 396.05, 367, 369; 249/4, 5, 18, 14, 219 R, 194, 20, 21, 120, 126, 139, 3, 9

(56) References Cited

U.S. PATENT DOCUMENTS

| | | | | | |
|---|---|---|---|---|---|
| 1,005,543 | A | * | 10/1911 | Heltzel | 249/193 |
| 1,700,889 | A | * | 2/1929 | Heltzel | 249/4 |
| 1,939,007 | A | * | 12/1933 | Heltzel | 264/31 |
| 2,610,380 | A | * | 9/1952 | Pollman | 249/14 |
| 2,611,169 | A | * | 9/1952 | Torrelli | 249/4 |
| 2,663,925 | A | * | 12/1953 | Yates | 249/6 |
| 3,182,948 | A | | 5/1965 | Lawrence | |
| 3,284,042 | A | * | 11/1966 | Ingalise | 249/14 |
| 3,495,800 | A | | 2/1970 | Fisher | |
| 3,841,595 | A | * | 10/1974 | Brown | 249/14 |
| 4,443,981 | A | | 4/1984 | Weiss | 52/155 |
| 4,444,374 | A | | 4/1984 | Gramstad | 249/14 |
| 4,824,068 | A | * | 4/1989 | Ferland | 249/2 |
| 4,846,437 | A | | 7/1989 | Fitzgerald | 249/3 |
| 5,205,942 | A | * | 4/1993 | Fitzgerald | 249/3 |
| 5,261,635 | A | * | 11/1993 | Flathau | 249/7 |
| 5,766,645 | A | | 6/1998 | Kaminski | 425/63 |
| 6,021,994 | A | * | 2/2000 | Shartzer, Jr. | 249/6 |
| 6,550,213 | B1 | * | 4/2003 | Butler | 52/741.15 |

FOREIGN PATENT DOCUMENTS

| | | |
|---|---|---|
| EP | 0436392 | 7/1991 |

* cited by examiner

*Primary Examiner*—Carl D. Friedman
*Assistant Examiner*—Nahid Amiri
(74) *Attorney, Agent, or Firm*—James G O'Neill, Klein & Singh, LLP

(57) ABSTRACT

A system and method for forming changes in elevation in a concrete slab includes one or more channels having substantially parallel bottom and top edges. The bottom and top edges include bent ends and a number of spaced apertures are formed in the bottom and top edges and the bent ends. Braces are inserted into the apertures to support the channel or channels in a vertical position. On or more different type bolt holders are selectively insertable into the channels for holding "J" bolts in a vertical position, parallel to the channels. Connecting elements are included for holding adjacent ends of separate channels together.

17 Claims, 5 Drawing Sheets

CONCRETE DECK DEPRESSION FORM SYSTEM

BACKGROUND OF THE INVENTION

1. Field of the Invention

This invention generally relates to concrete forming systems, and more particularly, to an improved system for forming changes in elevations in concrete slabs.

2. Description of the Prior Art

In large and other size buildings, such as apartments, offices, R&D facilities, and the like, changes in elevations to concrete floors are usually made using wooden or metal forms. These forms are normally secured in place and both the forms and securing elements are removed after the concrete sets.

Many problems occur because of the use of these known forms, their securing elements, and the removal thereof.

To overcome problems with the known forms, various types of metal concrete forming systems have been devised. In particular, U.S. Pat. No. 4,443,981 to Weiss, discloses a metal concrete forming system in which the form remains in place after the concrete is poured. The system consists of longitudinal rails connected to stakes and includes clips which fit snugly and securely together over angled portions of the rails to hold a number of elongated rails together. In addition, a corner holder is provided to secure two perpendicular rails together to complete a form. However, because of the shape of the rails and the use of the stakes, this type of a forming system could not be used in buildings where changes in elevations are needed.

Other devices are known which show different constructions of metal forms and brackets or braces. However, none of the known devices contain the specific structural form, braces and holding members of the present invention, nor are they for use in forming changes in elevation in poured concrete surfaces. Therefore, there exists a need in the art for an improved method and system for forming changes in elevations in poured concrete surfaces.

SUMMARY OF THE INVENTION

It is, therefore, a general object of the present invention to provide an improved concrete forming system. It is a particular object of the present invention to provide an improved and simplified form system for forming changes in elevations in poured concrete. It is another particular object of the present invention to provide an improved and simplified concrete forming system for use in providing changes in elevation in a concrete slab, which forming system remains in place after the concrete is set. It is a further particular object of the present invention to provide a concrete forming system including a channel having a plurality of braces for use therewith. It is yet another particular object of the present invention to provide a concrete forming system including connecting members adapted to connect a plurality of channels held in place by a plurality of modified braces. And it is a still further object of the present invention to provide an improved method and apparatus for forming changes in elevation in concrete slabs utilizing a specifically formed channel, supported by a series of braces, as well as various corner or radius forming elements connecting adjacent channels, and safety bolt holders to releasably support J bolts and eliminate protruding rebar, or the like.

These and other objects of the present invention are achieved by providing a permanent in-place system for forming changes in elevation in a concrete surface having at least one substantially channel-shaped body with specifically formed top and bottom edges adapted to hold braces, secured thereto at an angle, for supporting the substantially channel-shaped body at a work site. A plurality of spaced brace-holding openings are formed in the top and bottom edges and a plurality of braces having shaped ends are inserted into selected ones of the plurality of brace-holding openings for supporting the channel-shaped body in a vertical position to form changes in elevations in poured concrete.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in conjunction with the accompanying drawings, in which:

DESCRIPTION OF THE PREFERRED EMBODIMENTS

Figure 1:
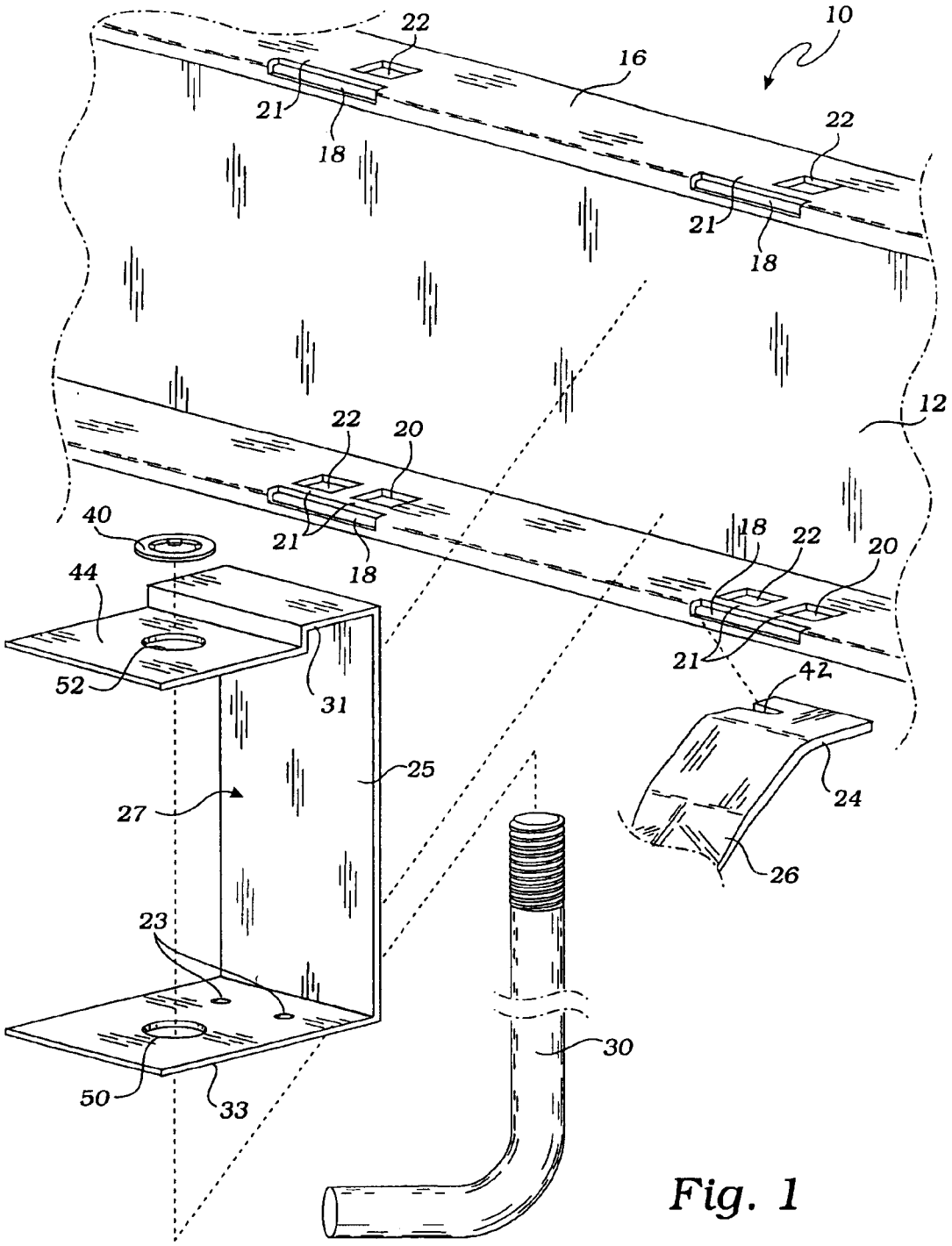
FIG. 1 is a partial exploded perspective view showing a substantially channel-shaped body having a plurality of brace-holding openings formed in bent edges thereof, a first embodiment of an insertable bracket for holding a J bolt, a J bolt and the end of a preferred brace of the present invention.

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide for a novel and improved method and system for forming changes in elevation in a formed concrete slab.

Referring to the drawings, there shown is a preferred embodiment of the invention for use in forming changes in elevations, such as breaks, depressions, steps, water breaks, or the like in poured concrete floors or surfaces for large office, residential or other buildings.

The system of the present invention is used on a bottom, ground or other floor, and may be secured in place over rebar and other concrete forming, holding or strengthening elements to hold sections of concrete in place to form changes in elevation. After forming of a depression, stair or other change in elevation, the channel-shaped system of the present invention remains in place to prevent spawling of the concrete, after the slab and change in elevation are formed.

The system of the present invention also utilizes supporting braces and brackets or bolt holders to hold J bolts in a vertical position. The brackets or bolt holders snap into position in the channel-shaped elements and may be held in place by securing means. The J bolt brackets or holders provide an added safety feature in that the J bolts held therein, either by a nut or holding washer, before concrete is poured, will move downwardly if struck or fallen upon, to avoid injuries caused by vertically extending rebar, or the like, normally used in such situations.

Turning now to FIG. 1, there shown is a partial exploded perspective view of a currently preferred embodiment of a substantially channel-shaped body 10 having an elongated flat central face or surface 12, which is preferably held in a vertical position. A bottom side edge 14 and a top side edge 16, both of which extend from the same side of the surface 12, at approximately 90°. The bottom side edge 14 and top side edge 16 are preferably parallel to each other and include bent over or rounded outer ends 15, 17, generally formed perpendicular to the bottom and top side edges and parallel to the central face 12. A plurality of brace holding means 18, such as apertures or openings, are formed in the channel shaped body 10, as by machining, molding, punching or the like. These brace holding means 18 are preferably formed in the outer ends 15, 17 and preferably extend into adjacent portions of the bottom and top side edges 14, 16. Additionally, a plurality of aligned further openings 20, 22 is formed in the bottom edge 14 and top edge 16. As shown, the top edge 16 has a single opening 22, while the bottom edge 14 preferably has a pair of openings 20, 22. Bridging members or sections 21 are formed in the bottom and top side edges 14, 16, between the brace holding means 18 and the openings 20, 22. The bridging sections 21 allow shaped ends 24 of braces 26, described in more detail below, to be inserted in the brace holding means 18 and firmly held in place, when the bridging sections are crimped or otherwise bent against the inserted shaped ends 24 of the braces. The brace holding means 18 and two openings 20, 22 in the bottom edge 14 allow shaped ends 24 of brace elements 26 to be inserted and held in the channel-shaped body 10 from either side or direction (front or rear) and the sections 21 to be crimped, punched or pushed down to secure the inserted shaped ends 24 of the braces 26 in position. The lower portions of the brace elements 26, against the ground or flooring are formed so as to be non-skid and are held in place by a nail or the like.

The channel-shaped body 10 may be made from fiberglass, metal or plastic, but is preferably made from a metal, such as aluminum or steel.

As shown in FIGS. 1–7 a plurality of different shaped bolt holders 27, 28, 29 are selectively inserted and held in the channel-shaped body 10, against the face 12 and between the side edges 14, 16, for holding bolts 30, such as J or L shaped bolts, as is explained more fully below. The bolt holders 27, 28, 29 are substantially U-shaped with a top bent, multi-level or offset portion 31, back portions 25 and different bottom or lower portions 33, 35, 37. The bolt holders 27, 28, 29 may be made from the same or different material as the channel-shaped body 10.

Figure 4:
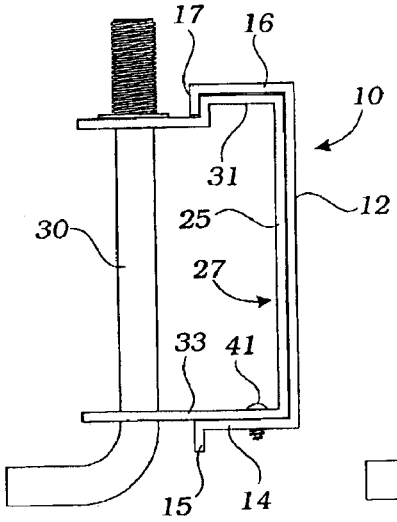
FIGS. 4–6 are side elevational views of the currently preferred embodiments of the brackets of the present invention inserted and held in the channel-shaped body and supporting J bolts therein.
Figure 5:
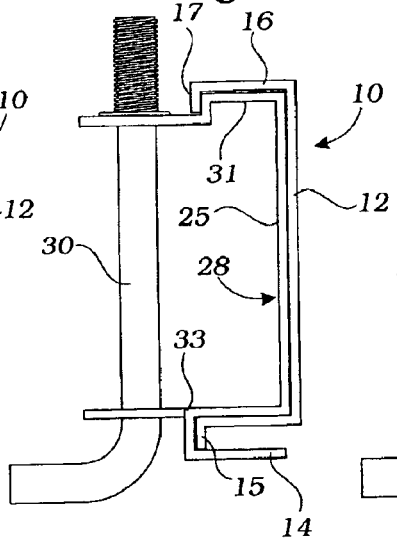
Figure 6:
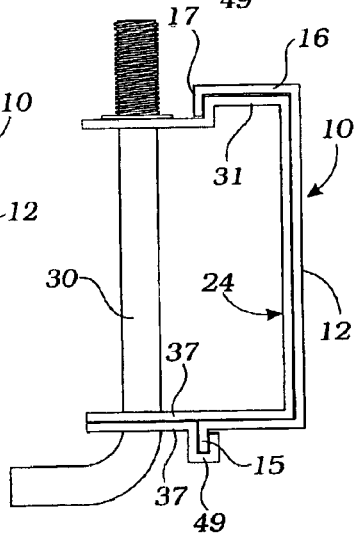

As best shown in FIGS. 4–6, the bolt holders 27, 28, 29 are inserted and held in the channel members 10 with offset portions 31 of the tops captured between the top side edge 16 and the outer end 17. The back portions 25 rest against, or are substantially parallel to the central face 12, while the different bottom or lower portions 33, 35, 37 are secured to the bottom edge 14 and bent outer end 15. The bottom or lower portions 33, 35, 37 may have clips inserted thereon to hold the bolt holder to the channel shaped body 10.

As best shown in FIGS. 1 and 4, in the first embodiment of the bracket 27, the bottom or lower portion 33 includes a pair of apertures 23 through which securing means 41, such as screws may be inserted into aligned apertures formed in lower edge 14 to secure the bracket in place. Additionally, a clip may be inserted over the lower portion 33 and bent end 15 so as to firmly secure the channel 10 and bracket 27 together.

Figure 2:
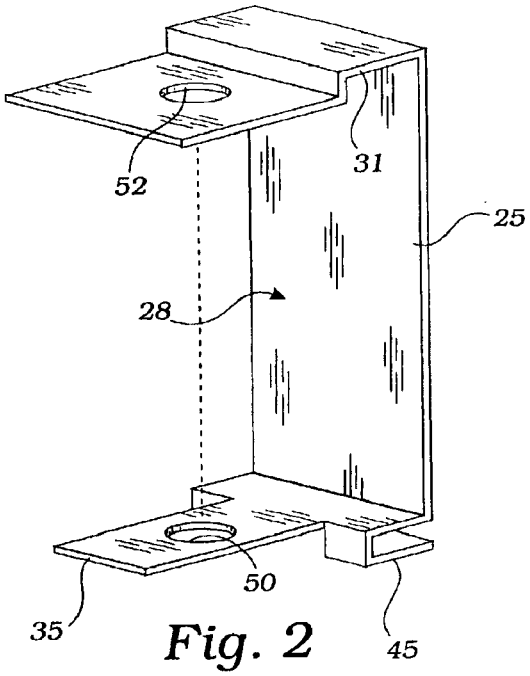
FIG. 2 is a perspective view of a second embodiment of a bracket for use with the channel of the present invention.

Turning to FIGS. 2 and 5, in the second embodiment of the bracket 28, the bottom or lower portion 35 includes a pair of bent over or U-shaped holding portions 45 for insertion over the bent ends 15 on lower edge 14. These U-shaped holding portions 45 may be bent or crimped to secure the bracket in place.

Figure 3:
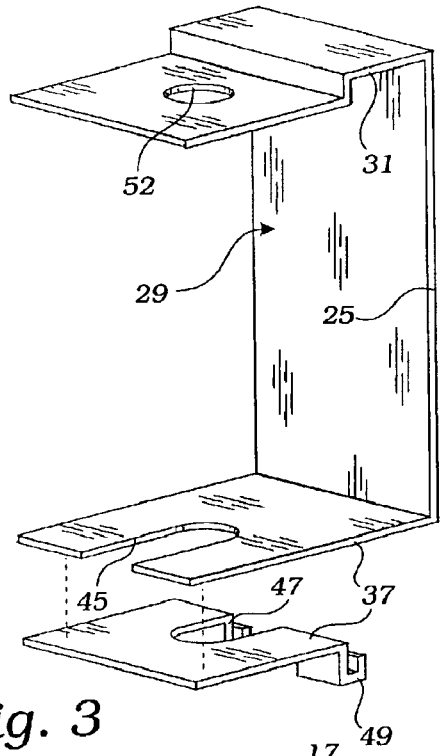
FIG. 3 is a perspective view of a third embodiment of a bracket for use with the channel of the present invention.

Turning to FIGS. 3 and 6, in the third embodiment of the bracket 29, the bottom or lower portion 37 includes a pair of separate sections having aligned U-shaped openings 43, 47 through which the J bolt extends. Additionally, the lower section of lower portion 37 includes a pair of further U-shaped holding portions 49 for insertion over the bent ends 15 on lower edge 14 to secure the bracket in place. Securing means, not shown, such as an epoxy, screws, or the like may be used to hold or clamp the two sections of the lower portion 37 to the lower edge 14 and bent end 15.

Figure 7:
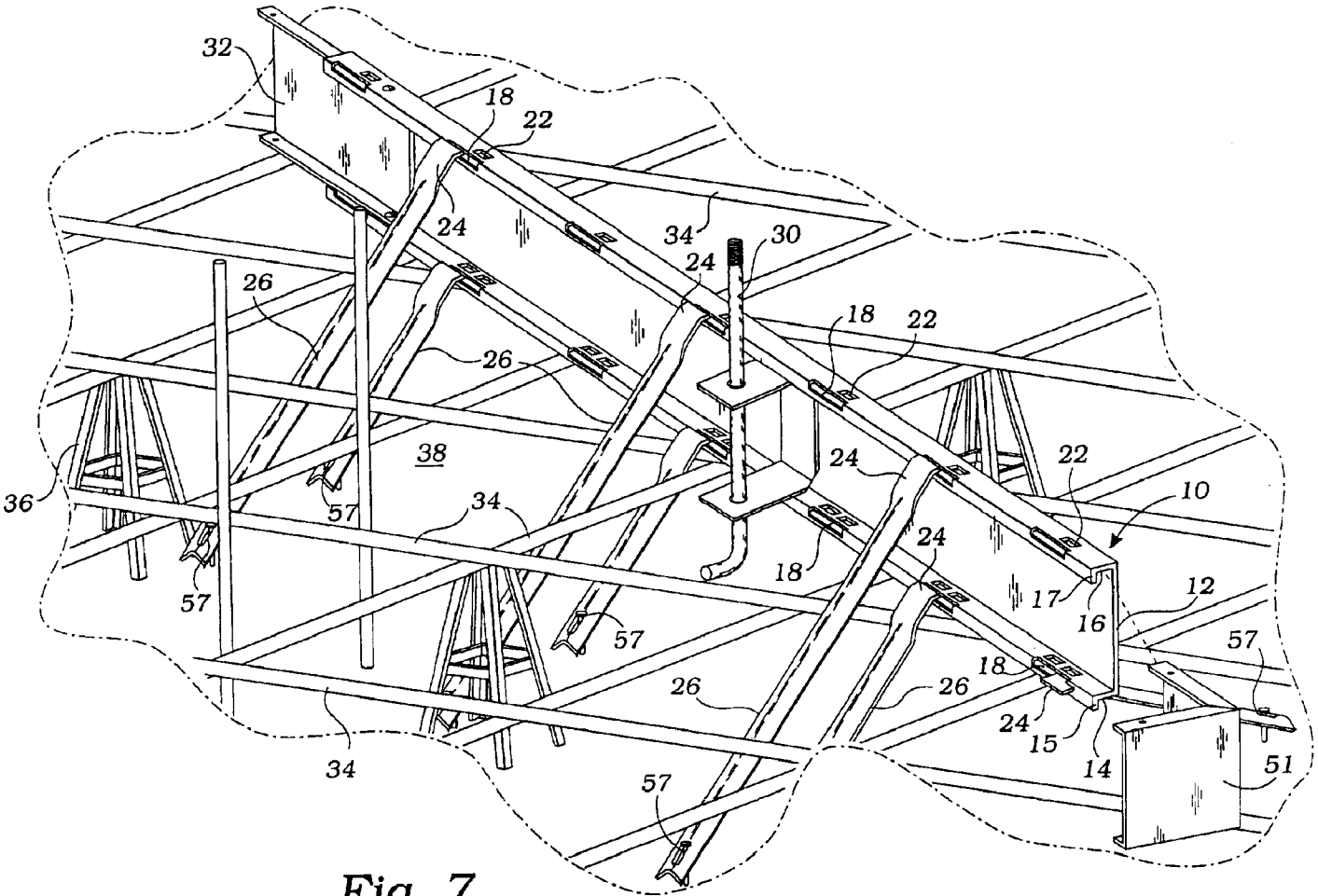
FIG. 7 is a further partial perspective view of an assembled channel-shaped body held in position in a building to form a change in elevation in a poured concrete surface; the channel-shaped body includes one of the J bolt-holding brackets having a J bolt secured therein, a plurality of braces holding the channel-shaped body in a vertical position above concrete strengthening members, a splice at one end of the channel-shaped body and a corner connection at a further end of the channel-shaped body.
Figure 9:
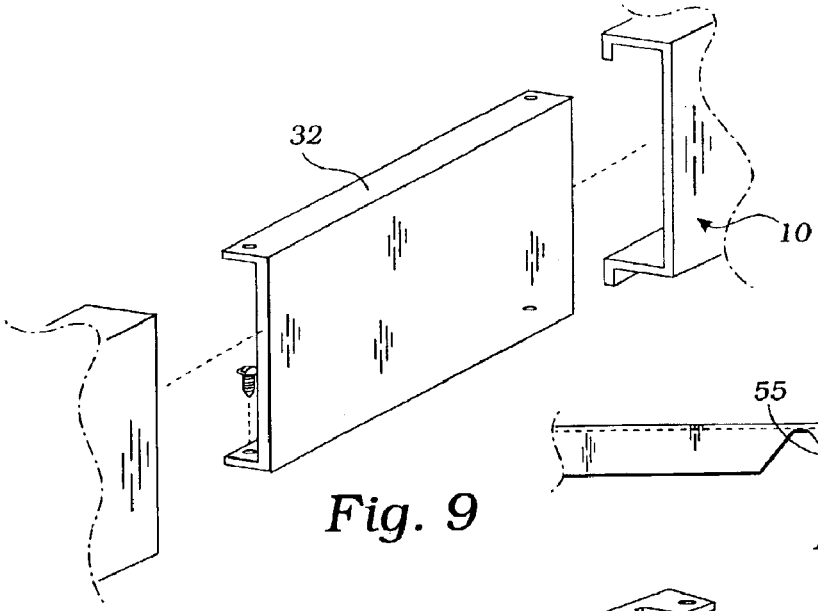
FIGS. 9–14 are examples of different types of connecting members or splices for use with the channel-shaped body in making changes in elevation in accordance with the present invention.
Figure 10:
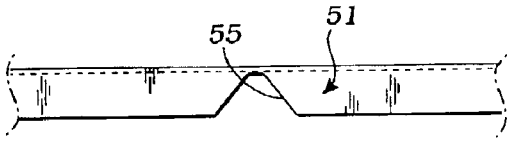
Figure 11:
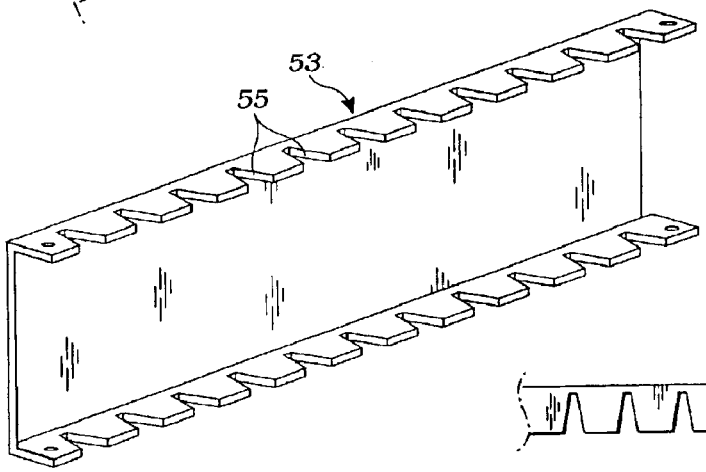
Figure 12:
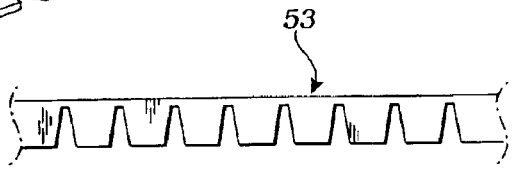
Figure 13:
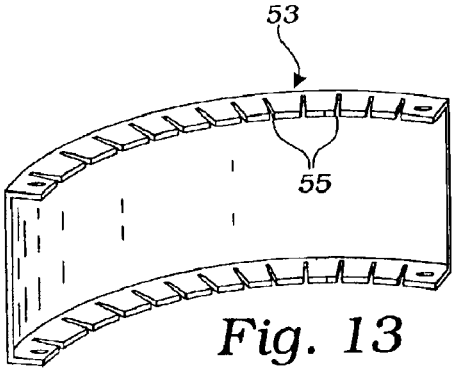
Figure 14:
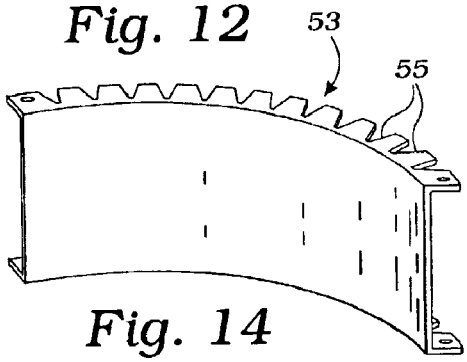

The system of the present invention is used to form changes in elevation, such as depressions or steps in concrete surfaces. As shown in FIGS. 7 and 9 a plurality of channels 10 may be secured together, as by means of splices 32, to form elongated systems. Furthermore, corner members 51 having single notches 55, or other connecting members 53, having a plurality of notches 55 to enable them to be bent in either direction to form inside or outside curved portions or radiuses, may be inserted into the ends of adjacent channels (see FIGS. 7 and 10–14). When fitted together, using either straight, angled or rounded portions, a plurality of channels 10 would provide a form that remains in place after concrete is poured in the form.

Figure 8:
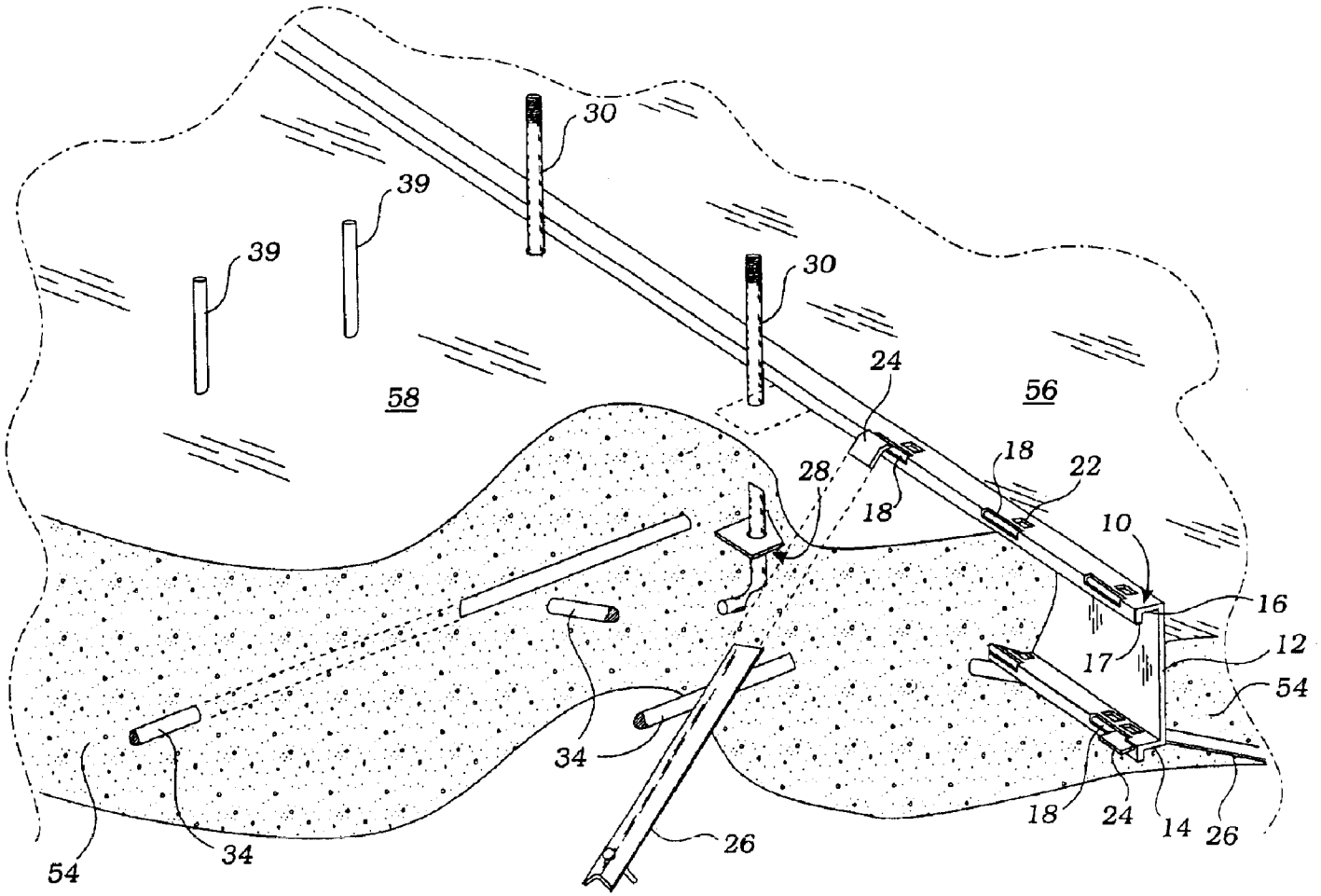
FIG. 8 is a further partial perspective view, similar to FIG. 7 after concrete has been poured so as to form a slab having a change in elevation, or a depression with the channel-shaped body as the face thereof.

As shown in FIGS. 7 and 8, the channel or channels 10 are supported in a vertical position over a surface 38. A plurality of horizontal rebars 34, as well as jack stands 36, or other concrete reinforcing or supporting elements, may be mounted on the surface 38, under the channel 10. The surface 38 may be the ground, or any other type surface on which a concrete slab is to be poured. Vertical rebar 39 may also be used. The channel-shaped body or bodies 10 are maintained in the vertical position, relative to the surface 38, by a plurality of the elongated braces 26. The elongated braces 26 are preferably made from metal and include shaped upper ends 24, which shaped upper ends may be bent, as shown. The elongated braces 26 are secured to the surface 38 at a second or lower end, as by means of a nail driven through an opening 57 and are sized and shaped so as to be non-skid on the surface 38.

The upper ends are inserted in selected openings 18 and held therein, as explained above. A depression or partial opening 42 may be formed in the ends 24 of braces 26 in order to be more positively captured by the crimping of bridging members 21, when the ends 24 are inserted in openings 18.

The U-shaped bolt holder 27, 28 are provided with aligned circular openings 50, 52, while the bolt holder 29 is provided with a top opening 52 and aligned U-shaped lower openings 43, 47. In use, a plurality of bolt holders 27, 28 or 29 are inserted and held in the channel 10 as explained above, with J bolts 30 inserted through the aligned circular openings 50, 52 or U-shaped openings 43, 47 in each bolt holder. The J bolts 30 may be held in position in any known manner, such as by means of a clip, nut or washer 40.

When the desired form, comprised of at least one channel 10, supported by a plurality of braces 26 and having at least one bolt holder, such as 28, and a J bolt 30 secured in position, is completed, concrete 54 is poured onto the surface 38, and to the desired depth so as to reach a first level and the top edge 16 of channel 10 (see FIG. 8). It is to be understood that further forms not shown would be used to hold the poured concrete slab 54 around corners and radiused portions at its outer periphery. After the concrete 54 sets, the system of the present invention stays in place, with the braces, bolt holders and the lower portion of the J bolts secured in the concrete. An outside surface of the channel 10 or radiused connections will form the outer face of the break or depression formed in the slab of concrete 54. That is, two different elevations 56 and 58 will be formed, and will be separated by the outer face of channel 10 and or other connecting portions, which channel or other connecting portion will have their inner surfaces, as well as the bottom and top edges 14, 16 of the channel held in or to the concrete to form a covered or protected surface between the lower elevation 56 and the higher elevation 58.

Thus, there has been described an improved system and method for producing in a simplified and expeditious manner, changes in elevation in concrete slabs. The edge or outer surface of the change in elevation will be covered by a channel and any connecting elements made from metal, plastic or fiberglass to provide a more aesthetic and longer lasting break.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than is specifically described herein.

What is claimed is:

1. A permanent, in-place system for forming changes in elevations in a poured concrete surface, comprising:

at least one channel-shaped body having a first elongated surface with bottom and top edges secured thereto at approximately 90°;

a plurality of spaced brace-holding means formed in the bottom and top edges;

at least one substantially U-shaped bolt-holding bracket, inserted and held in the at least one channel-shaped body between facing surfaces of the bottom and top edges; and a plurality of bracing elements for insertion into selected ones of the plurality of brace holding means for supporting the at least one channel-shaped body in a vertical position, with the bottom and top edges substantially parallel to a surface to be covered by concrete.

2. The system of claim 1, further including a J bolt held in the at least one substantially U-shaped bolt-holding bracket.

3. The system of claim 2 wherein the brace-holding means are apertures formed in the bottom and top edges.

4. The system of claim 3 wherein the bottom and top edges include bent end portions and the apertures extend into the bent end portions.

5. The system of claim 4 wherein the plurality of bracing elements include shaped ends having partial openings formed therein, and the shaped ends are inserted into selected ones of the aperture.

6. The system of claim 1 wherein the bottom and top edges include bent end portions.

7. The system of claim 6, wherein the at least one substantially U-shaped bolt-holding bracket is inserted and held in the at least one channel-shaped body between facing surfaces of the bottom and top edges and the bent end portions.

8. The system of claim 6 wherein the brace-holding means are apertures formed in the bottom and top edges and extending into the bent end portions.

9. The system of claim 8, further including a J bolt held in the at least one substantially U-shaped bolt-holding bracket.

10. A permanent, in-place system for forming changes in elevations in a poured concrete surface, comprising:

at least one channel-shaped body having a first elongated flat surface with bottom and top edges extending therefrom at approximately 90°;

a plurality of spaced openings formed in the bottom and top edges;

a plurality of spaced apertures formed on outer ends of the bottom and top edges; and a plurality of bracing elements having shaped ends for insertion into selected ones of the plurality of spaced apertures for supporting the at least one channel-shaped body in a vertical position, with the bottom and top edges substantially parallel to a surface to be covered by poured concrete.

11. The system of claim 10, further including at least one substantially U-shaped bolt-holding bracket, inserted and held in the at least one channel-shaped body between facing surfaces of the bottom and top edges.

12. The system of claim 11, further including a J bolt held in the U-shaped bolt-holding bracket.

13. The system of claim 12 wherein there is a plurality of channel-shaped bodies and they are secured together by at least one connecting member secured between adjacent ends of each of the plurality of channel-shaped bodies.

14. The system of claim 13, further including bridging sections formed between the apertures and the plurality of spaced openings formed in the bottom and top edges, and the plurality of bracing elements include shaped ends which are inserted into selected apertures and held by crimped bridging sections.

15. The system of claim 14 wherein the shaped ends include partial openings formed therein.

16. A permanent, in-place system for forming changes in elevations in a poured concrete surface, comprising:

a plurality of channel-shaped bodies having elongated surfaces with substantially perpendicular bottom and top edges;

the substantially perpendicular bottom and top edges having bent ends formed thereon;

a plurality of spaced apertures formed in the substantially perpendicular bottom and top edges and extending into the bent ends;

means for holding the plurality of channel-shaped bodies together;

a plurality of bracing elements having shaped ends for insertion into selected ones of the plurality of spaced apertures for maintaining the plurality of channel-shaped bodies in a vertical position with the bottom and top edges substantially parallel to a surface to be covered by concrete;

a plurality of bolt holders having aligned openings therein inserted and held in the plurality of channel-shaped bodies between the substantially perpendicular bottom and top edges; and a plurality of "J" bolts held in the aligned openings in the bolt holders and extending substantially parallel to the vertical channel-shaped bodies.

17. The system of claim 16, further including connecting members inserted between adjacent ends of the plurality of channel-shaped bodies to secure the plurality of channel-shaped bodies together.

* * * * *